US005324042A

United States Patent [19]

Demas

[11] Patent Number: 5,324,042

[45] Date of Patent: Jun. 28, 1994

[54] AERIAL PROJECTILE AND TARGET APPARATUS FOR USE IN PLAYING A LAWN TARGET GAME

[76] Inventor: Christopher Demas, 153 Bedford Rd., Fairless Hills, Pa. 19030

[21] Appl. No.: 125,278

[22] Filed: Sep. 23, 1993

[51] Int. Cl.[5] ..... A63B 67/00

[52] U.S. Cl. ..... 273/346; 273/401; 273/415; 273/DIG. 30

[58] Field of Search ..... 273/346, 348, 398, 400, 273/401, 415, DIG. 30

[56] References Cited

U.S. PATENT DOCUMENTS

| | | | |
|---|---|---|---|
| 2,923,548 | 2/1960 | Kappel | 273/386 |
| 3,480,280 | 11/1969 | Gamertsfelder | 273/415 |
| 3,628,793 | 12/1971 | Mudloff | 273/415 X |
| 3,917,271 | 11/1975 | Lemelson et al. | 273/346 |
| 3,941,383 | 3/1976 | Clarke | 273/346 |
| 3,953,030 | 4/1976 | Muchnick | 273/346 |
| 3,999,748 | 12/1976 | Clarke | 273/346 |
| 4,012,042 | 3/1977 | Blasingame | 273/401 |
| 4,017,076 | 4/1977 | Bai | 273/346 |
| 4,029,316 | 6/1977 | Clarke | 273/346 X |
| 4,113,251 | 9/1978 | Imes, Jr. | 273/346 |
| 4,150,823 | 4/1979 | Boganowski | 273/346 |
| 4,186,925 | 2/1980 | Goldfarb et al. | 273/415 X |
| 4,240,639 | 12/1980 | Bolton et al. | 273/346 |
| 4,486,023 | 12/1984 | Tomoff | 273/348 |
| 4,736,955 | 4/1988 | Pollock | 273/346 X |
| 4,971,333 | 11/1990 | Buselli | 273/346 |
| 4,986,549 | 1/1991 | Kuhtic et al. | 273/415 X |
| 5,016,891 | 5/1991 | Nelson | 273/348 X |
| 5,067,727 | 11/1991 | Crompton | 273/346 X |

*Primary Examiner*—William H. Grieb
*Attorney, Agent, or Firm*—Sperry, Zoda & Kane

[57] ABSTRACT

A lawn game apparatus including a bag-like throwing member used to be thrown at a target member defining a plurality of target zones therein. The bag-like throwing member includes an internal chamber with loose pelletized filler material to provide weight to facilitate throwing of the bag-like member. The bag-like member includes a hook and loop interconnecting securement means on one end thereof adapted to engage other hook and loop securement sections within the specific target zones to facilitate securement thereto and for scoring of the game. The bag-like throwing member includes two sides both of flexible material with only one side coated with the hook and loop interengagement means to facilitate formation of game strategies and enhance game play.

21 Claims, 2 Drawing Sheets

AERIAL PROJECTILE AND TARGET APPARATUS FOR USE IN PLAYING A LAWN TARGET GAME

BACKGROUND OF THE INVENTION

1. Field Of The Invention

The present invention deals with the field of devices of games and in particular lawn games utilizing thrown projectiles and specifically designed targets. The specific design of the targets of the present invention is adaptable for use to simulate games such as horseshoes, baseball, shuffleboard and the like.

2. Description Of The Prior Art

Other prior art devices have been conceived and patented utilizing various types of projectiles and targets. Some of these games may be utilized as lawn games and others require specific equipment. Examples of such games are shown in U.S. Pat. No. 2,923,548 patented Feb. 2, 1960 to M. Kappel on an "Aerial Projectile Game"; and U.S. Pat. No. 3,628,793 patented Dec. 21, 1971 to R. Mudloff on a "Sandbag And Target Apparatus In Which The Target Also Serves As A Carrying Case"; and U.S. Pat. No. 3,917,271 patented Nov. 4, 1975 to J. Lemelson et al on a "Ball For Target Games"; and U.S. Pat. No. 3,941,383 patented Mar. 2, 1976 to W. Clarke on a "Velcro Projectile And Target"; and U.S. Pat. No. 3,953,030 patented Apr. 27, 1976 to B. Muchnick on a "Throw And Catch Toy"; and U.S. Pat. No. 3,999,748 patented Dec. 28, 1976 to W. Clarke on a "Childrens Game Of Catch"; and U.S Pat. No. 4,017,076 patented Apr. 12, 1977 to H. Bai on a "Target Game"; and U.S. Pat. No. 4,029,316 patented Jun. 14, 1977 to W. Clarke on a "Game Ball"; and U.S. Pat. No. 4,113,251 patented Sep. 12, 1978 to J. Imes, Jr. and assigned to RB Toy Development Co. on a "Target Game"; and U.S. Pat. No. 4,150,823 patented Apr. 24, 1979 to D. Boganowski on a "Targetable Projectile Amusement Apparatus"; and U.S. Pat. No. 4,186,925 patented Feb. 5, 1980 to A. Goldfarb et al and assigned to Adolph E. Goldfarb; Elisabeth Benkoe, executrix for the estate of Erwin Benkoe on a "Competitive Toss Game"; and U.S. Pat. No. 4,240,639 patented Dec. 23, 1980 to D. Bolton et al and assigned to Cadaco, Inc. on a "Toss Ball Construction"; and U.S. Pat. No. 4,486,023 patented Dec. 4, 1984 to J. Tomoff on an "Educational Game Device Of The Colored Pattern Type"; and U.S. Pat. No. 4,971,333 patented Nov. 20, 1990 to O. Buselli on a "Wall Mounted Decorative Art Convertible To A Toss Game With Catch Area"; and U.S. Pat. No. 5,016,891 patented May 21, 1991 to D. Nelson on a "Projectile-Target Game Apparatus"; and U.S. Pat. No. 5,067,727 patented Nov. 26, 1991 to P. Crompton on a "Ring Toss Game".

SUMMARY OF THE INVENTION

An aerial projectile and target apparatus particularly usable for playing of target games and preferably for target lawn games which includes a bag-like throwing member formed by two flexible members which are attached peripherally with respect to one another. Each of the flexible members is preferably square and is approximately 3½ inches to 4 inches along each side. Each flexible member defines an outer surface and an inner surface and with the inner surfaces being adjacent to one another and the outer surfaces being spatially disposed facing outwardly opposite from one another. In this manner the inner surfaces of the two flexible members will define an internal chamber therebetween. A pelletized filler material will be adapted to be positioned within the internal chamber of this bag-like throwing member for weighting thereof to facilitate tossing and targeting of the bag-like throwing member.

The first flexible member preferably will also include a hook and loop interlocking material fixedly secured thereto and defined as the throwing hook and loop interlocking material section. This section will be engageable with respect to other hook and loop interlocking material sections positioned within the various target areas of the throwing target.

The target member will preferably define a plurality of target zones to facilitate target game play by tossing of this bag-like throwing member thereagainst or thereon. The targeting member preferably will include a primary target zone for providing a primary target during game play with the primary target zone including a primary hook and loop interlocking material section affixed therein for selectively being engageable with respect to the throwing hook and look interlocking material section on the bag-like throwing member to facilitate retaining thereof within the primary target zone selectively. Furthermore the target will include a secondary target zone for providing a secondary target during game play which includes a secondary hook and loop interlocking material section affixed therein which is adapted to selectively engage the throwing hook and look interlocking material section on the bag-like throwing member to facilitate retaining it within the secondary target zone selectively. The target may include a tertiary target zone for providing a tertiary target during game play and which includes a tertiary hook and loop interlocking material section affixed therein which is adapted to be selectively engageable with respect to the throwing hook and loop interlocking section on the bag-like throwing member to facilitate retaining thereof within the tertiary target zone.

The throwing hook and loop interlocking material section on the bag-like throwing member preferably will include two individual strips of the hook and loop interlocking material to facilitate selective engagement thereof with respect to various portions of the target member. These strip sections will preferably be approximately ¾ inch wide Velcro sections.

The pelletized filler material positioned within the internal chamber will comprise a plurality of discreet individual members such as pellets or stones or even sand which when positioned within the internal chamber provides shiftable and movable weight within the bag-like throwing member to facilitate tumbling and game play value thereof when thrown during playing of the target game. The game is further facilitated by the formation of the flexible members to be of a plastic material such as an imitation leather plastic material or other similar configuration. Preferably the weight of the pelletized filler material will be between 5 and 8 ounces to enhance game play. An additional zone may be defined as a quaternary target zone which can provide an additional target during game play. This additional target can be a detrimental target to be avoided by a game player or can be an attractive target which is desirable to game play.

In one embodiment of the game given the name, "Skid 21", the manner of play is somewhat similar in scoring to shuffleboard wherein all of the zones are rectangular with the secondary zone being adjacent to the primary zone and being slightly larger. In a similar manner the tertiary zone is positioned adjacent to the secondary zone and is larger than the secondary zone. Finally the quaternary zone is also adjacent to the primary zone and is of the same size and is positioned opposite from the adjacent positioning of the secondary zone. With this particular configuration and this game the positioning of the bag-like throwing member within the primary zone is a +3 score whereas positioning within the secondary zone is +2 score. Positioning within the tertiary zone is a +1 score and positioning within the quaternary zone is detrimental and is a −1 score.

In an alternative aspect of game play the board may define particular zones to simulate a baseball game which includes various zones for singles, doubles, triples and homeruns. Also a specific target zone may be included wherein the targets may be variously configured but preferably are configured with the primary target being circular and the secondary target being annular positioned about the primary target zone. The tertiary zone will be rectangular and positioned around the annular secondary zone with an optional quaternary zone being positioned adjacent to an edge of the tertiary zone.

It is an object of the present invention to provide an aerial projectile target apparatus for use in playing of a lawn target game wherein all game pieces are easily portable.

It is an object of the present invention to provide an aerial projectile target apparatus for use in playing of a lawn target game wherein set-up and take-down time is minimized.

It is an object of the present invention to provide an aerial projectile target apparatus for use in playing of a lawn target game wherein a target is provided which is detachably securable with respect to any lawn area.

It is an object of the present invention to provide an aerial projectile target apparatus for use in playing of a lawn target game wherein unique game strategies are provided by utilizing a bag-like throwing member having a hook and loop interlocking material only on one side thereof.

It is an object of the present invention to provide an aerial projectile target apparatus for use in playing of a lawn target game wherein initial costs of equipment for playing of the game is minimized.

It is an object of the present invention to provide an aerial projectile target apparatus for use in playing of a lawn target game wherein maintenance requirements are severely minimized.

It is an object of the present invention to provide an aerial projectile target apparatus for use in playing of a lawn target game wherein game rules are minimal to facilitate ease of play and enjoyment.

It is an object of the present invention to provide an aerial projectile target apparatus for use in playing of a lawn target game wherein game play be one, two, three, four or more players is possible.

It is an object of the present invention to provide an aerial projectile target apparatus for use in playing of a lawn target game wherein game scoring is easily decided.

It is an object of the present invention to provide an aerial projectile target apparatus for use in playing of a lawn target game wherein game strategies are unique and constantly changing.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
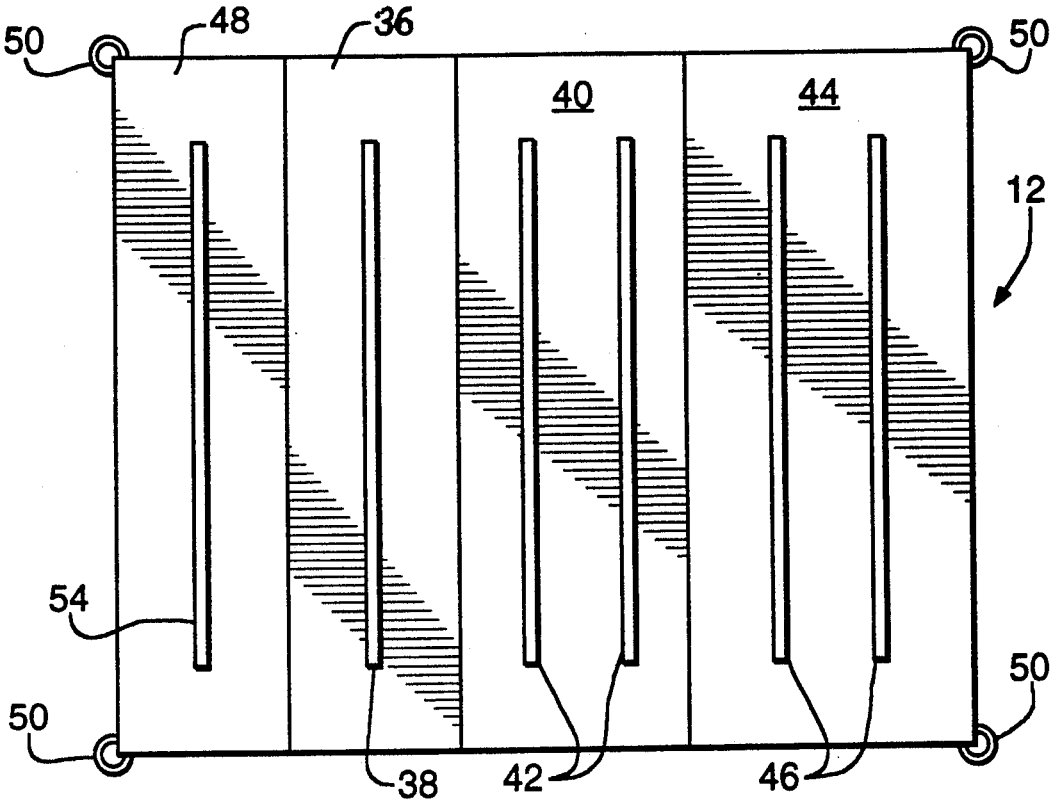
FIG. 1 is a top plan view of an embodiment of a target member of the present invention for use in playing "Skid 21"

The present invention provides an aerial projectile and target apparatus for use in playing of a lawn target game including a projectile 10 adapted to be thrown toward a target member 12.

The projectile 10 preferably comprises a bag-like throwing member 14 which is preferably formed of a first flexible member 16 and a second flexible member 24 fixedly secured peripherally about the outermost edge thereof. The first flexible member 16 and the second flexible member 24 preferably are of a square shape and of a plastic or plastic simulated leather material such as to enhance the flexibility thereof.

The first flexible member includes a first outer surface 18 and a first inner surface 20. The second flexible member also in a similar manner includes a second outer surface 26 and a second inner surface 28. The first flexible member 16 and the second flexible member 24 are secured peripherally with respect to one another such that the first inner surface 20 is immediately adjacent and facing the second inner surface 28. The first outer surface 18 of the first flexible member 16 is positioned opposite from and facing away from the second outer surface 26 of second flexible member 24. With this configuration the first inner surface 20 and the second inner surface 28 will define therebetween an internal chamber 32 bounded by the two flexible members and formed by the peripheral attachment 30 about the outermost periphery of the two flexible members.

This internal chamber 32 is adapted to receive a pelletized filler material 34 therein such as pellets which can be made of rubber or other material or even sand.

The bag-like throwing member 14 within this configuration is capable of being thrown or slung toward the target member 12 under certain game conditions. To enhance the ability to throw the throwing member 14 to specific locations upon the target member 12 the first outer surface 18 will include a throwing hook and loop interlocking material section 22 thereon. This section preferably will be formed as two longitudinal strips of approximately ¾ inch each. To further enhance the throwing of the bag-like throwing member 14 the pelletized filler material therein will weigh between 5 and 8 ounces to enhance the flight characteristics of member 14.

The hook and loop interlocking material section 22 on the first outer surface 18 of the bag-like throwing member 14 is commonly known by the trademark, Velcro. This is material including hook and loop members for interlocking with respect to other interlocking hook and loop material.

Figure 2:
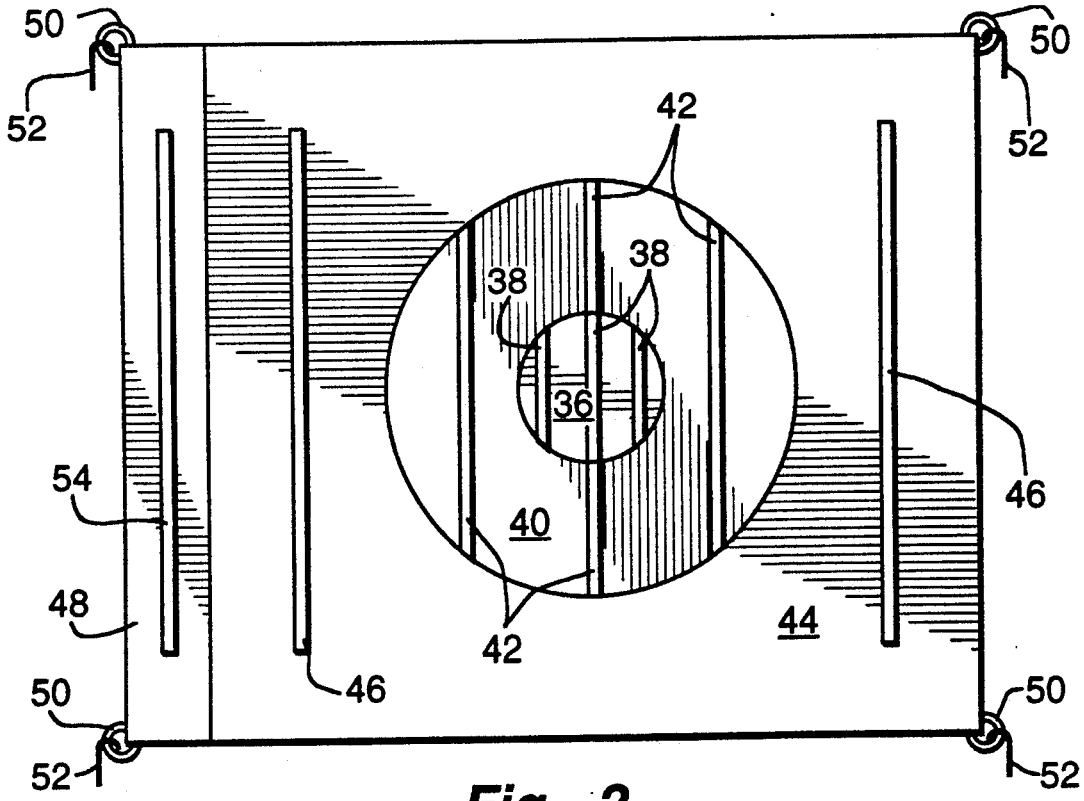
FIG. 2 is a top plan view of an embodiment of a target member of the present invention for use in playing "Bullseye" or "Baseball"
Figure 3:
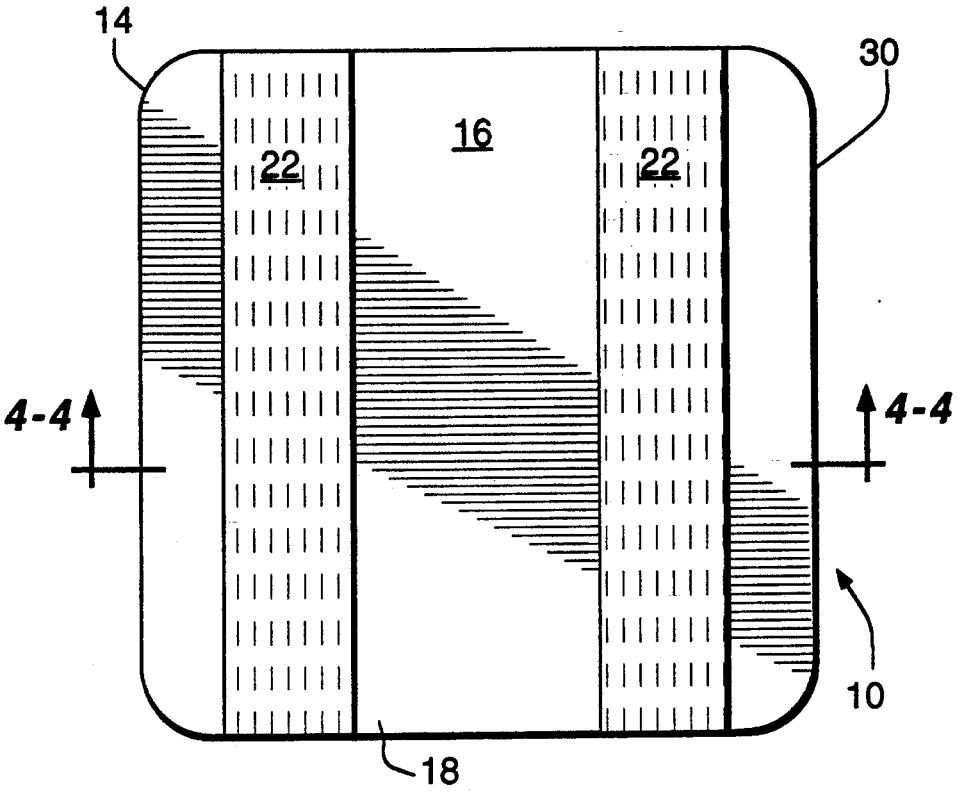
FIG. 3 is a top plan view of an embodiment of the bag-like throwing member for use with the present invention.
Figure 4:
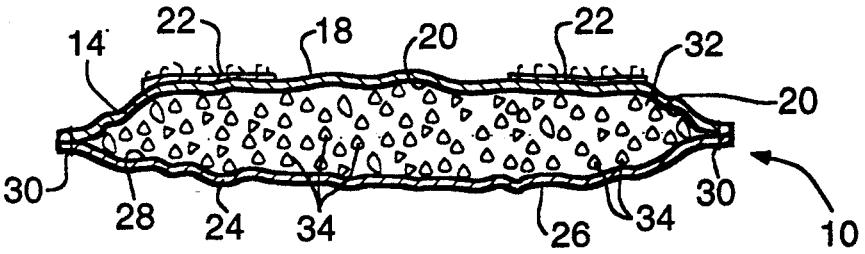
FIG. 4 is a cross-sectional view of FIG. 3 along lines 4—4.
Figure 5:
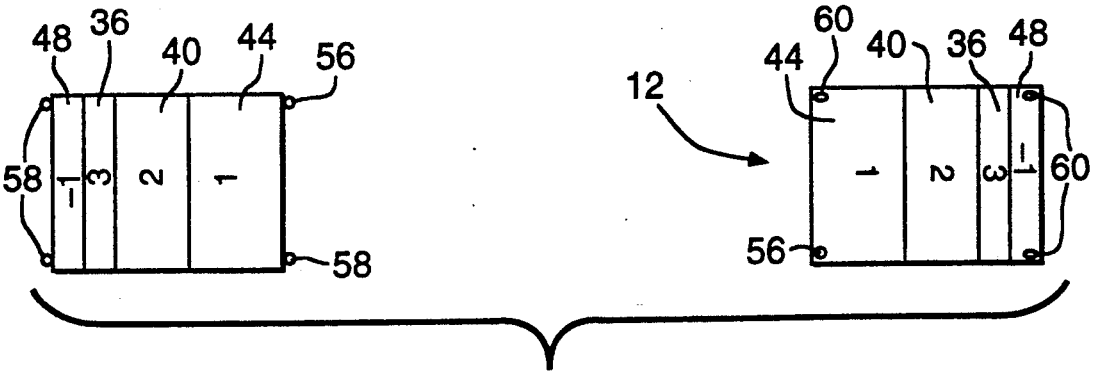
FIG. 5 is a top plan view of two of the targets as shown in FIG. 1 positioned spaced from one another to facilitate game play.

The target member 12 can be of various general configurations. However, it will require multiple target zones therein. Examples of such configurations are shown in FIGS. 1, 2 and 5 which each show a primary target zone 36 with a primary hook and loop interlocking material section 38 positioned therein. Also a secondary target section 40 is shown in each of the embodiments with a secondary hook and loop interlocking material section 42 also positioned therein. Each of the configurations further includes tertiary target zone 44 defined therein with a tertiary hook and loop interlocking material section 46 therein.

Each of the zones includes a hook and loop interlocking material section therein which is adapted to engage the throwing hook and look interlocking material section 22 of the bag-like throwing member 14. As such, when the player is throwing or tossing of the throwing member 14 toward one of the target zones as desired, skill will be involved in throwing the member 14 in such a manner that the throwing hook and loop interlocking material section 22 thereon engages with respect to the hook and loop interlocking material section of the desired target zone. When utilizing the "Skid 21" board shown in FIG. 1 or when utilizing the board shown in FIG. 2 for baseball play a quaternary target zone 48 may be included to thereby provide a fourth target area. This quaternary target zone 48 will include a quaternary hook and loop interlocking material section 54 therein to be engageable with the throwing hook and loop interlocking material section 22 of the bag-like throwing member 14 to facilitate retaining of the member 14 within the quaternary target zone 48 when thrown. In the configuration shown in FIG. 1 the quaternary zone is a detrimental zone rendering a −1 score whereas in the configuration shown in FIG. 2 the quaternary zone provides positive game results by rendering a homerun score for the player as in conventional baseball.

The individual target members 12 preferably are formed of a flat flexible material such as a plastic or the like which can be easily rolled to facilitate storage of the game apparatus of the present invention. To aid in speeding of game set up and to hold the target member 12 in position as desired a plurality of individual attachment rings 50 may be positioned at the corners of the target member 12 and may be secured with respect to the surrounding lawn or ground area by a plurality of stakes 52 as shown best in FIGS. 1 and 2.

The target member 12 shown in FIG. 1 is used specifically for playing of "Skid 21". With this game the primary target zone 36 and the secondary zone 40 are positioned immediately adjacent one another. The secondary zone is somewhat larger than the primary zone. The tertiary target zone 44 is positioned adjacent the secondary target zone 40 opposite from the positioning of the primary target zone 36 thereadjacent. Furthermore the tertiary target zone 44 is somewhat larger than the second target zone 40. The quaternary target zone 48 is positioned adjacent the primary target zone 36 and is of the same size. The quaternary target zone 48 is positioned adjacent the primary target zone 36 at a position opposite from the location of the secondary target zone 40. With this configuration as shown in FIG. 1 the primary target zone 36 is defined as the white area and provides a scoring of +3. The secondary target zone 40 is the blue area and defines a scoring result of +2. Thirdly the tertiary target zone 44 is the black zone and provides a scoring of +1. The quaternary target zone 48 is a detrimental target zone and provides a score of −1. The quaternary target zone 48 and the primary target zone 36 include a single hook and loop attaching strip therein. As shown in this configuration the secondary target zone includes two individual strips of hook and loop material and the tertiary target zone includes two strips of hook and loop interengaging material further spaced apart. This is necessary because the secondary target zone 40 and the tertiary target zone 44 are somewhat larger than the primary target zone 36 and the quaternary target zone 48.

In the preferred configuration the primary target zone 36 and the quaternary target zone 48 will each be approximately one foot in longitudinal length from the thrower whereas the secondary target zone 40 will preferably be approximately one foot four inches and the tertiary target zone 44 will measure approximately one foot eight inches.

In the scoring of "Skid 21" the first team to have 21 points wins and any toss landing in the quaternary target zone 48 resulting in a −1 score cancels all positive scores. Two scores within the same zone by opposite team members cancel one another. It is anticipated that each team will throw three separate bag-like throwing members each of which will be identified as having been thrown from a specific team by coloration thereof. For example, there may be three blue bags and three red bags.

With use of the alternative target member 12 as shown in FIG. 2, the game of "Bullseye" or "Baseball" can be played. With the game "Bullseye" the primary target zone 36 is shown to be a round target area designated the red area in the middle of the target member 12. Landing of a throwing member 14 within this area would result in a score of 3 points. The configuration of the secondary target zone 40 within the configuration shown in FIG. 2 is of an annular shape surrounding the primary target zone 36. Placement of the throwing member 14 within the secondary target zone 40 in the configuration shown in FIG. 2 also known as the blue zone would result in a score of 1 point. Placement of a throwing member overlapping the red and blue areas in the configuration shown in FIG. 2 would result in a score of 2 points.

The tertiary target zone 44 within the FIG. 2 configuration is rectangular and completely surrounds the annular secondary target zone 40. This tertiary target zone 44 is also known as the white area and results in a score of 0. When playing the game "Bullseye" normally the result is to reach exactly 21 with a score and wherein a "Bullseye" score by throwing of the throwing member 14 within the red area 3 voids all of your opponents scores. Also the last throw within this primary target zone 36 gets the 3 points resulting score.

The embodiment of the target member 12 shown in FIG. 2 also can be utilized to play "Baseball" wherein placement within the white area 44 is scored as a single whereas placement within the blue area 40 is scored as a double and placement within the red area or primary target zone 36 is scored as a triple. With this configuration it is preferable to add a quaternary target zone 48 as shown to the extreme left in FIG. 2 which is a rectangular area adjacent the white area at the location furthest from the thrower which includes the quaternary hook and loop interlocking material section 54 therein and is responsive to score a homerun by placement of the bag-like throwing member 14 therein. Scoring of this game is a simulation according to standard baseball rules.

Use of the design as shown in FIGS. 1 and 2 in a lawn area is made easy by the design of this embodiment of the present invention. On the other hand use in a lawn or non-lawn area is made possible by including a corner securement means 56 which may take the form of weighted objects 60 as shown best in the righthand side of FIG. 5. In an alternative configuration suction cups 58 can be utilized as the corner securement means 56 to peripherally attach the target member 12 to a floor area or a driveway area or other similar flat surface to facilitate playing of the lawn game of the present invention.

The lawn game of the present invention can utilize a target of any size whatsoever. However, it has been found preferable to use a total target size of approximately four feet by five feet to enhance playing characteristics. These dimensions of course can be varied by as much as six inches to accommodate slight variations in zone sizing.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An aerial projectile and target apparatus for use in playing a lawn target game comprising:

A. a bag-like throwing member including:

(1) a first flexible member defining a first outer surface and a first inner surface, said first outer surface of said first flexible member including a throwing hook and loop interlocking material section thereon to facilitate game play;

(2) a second flexible member defining a second outer surface and a second inner surface, said first flexible member and said second flexible member being peripherally attached with respect to one another with said first inner surface and said second inner surface being adjacently positioned facing one another and with said first outer surface and said second outer surface outwardly facing opposite from one another, said first inner surface and said second inner surface defining an internal chamber means therebetween;

B. a pelletized filler material positioned within said internal chamber means of said bag-like throwing member for weighting thereof to facilitate tossing and targeting thereof;

C. a target member defining a plurality of target zones to facilitate target game play by tossing of said bag-like throwing member therewithin, said target member including:

(1) a primary target zone for providing a primary target during game play, said primary target zone including a primary hook and loop interlocking material section affixed therein and adapted to be selectively engageable with respect to said throwing hook and loop interlocking material section on said bag-like throwing member to facilitate retaining thereof within said primary target zone;

(2) a secondary target zone for providing a secondary target during game play, said secondary target zone including a secondary hook and loop interlocking material section affixed therein and adapted to be selectively engageable with respect to said throwing hook and loop interlocking material section on said bag-like throwing member to facilitate retaining thereof within said secondary target zone; and (3) a tertiary target zone for providing a tertiary target during game play, said tertiary target zone including a tertiary hook and loop interlocking material section affixed therein and adapted to be selectively engageable with respect to said throwing hook and loop interlocking material section on said bag-like throwing member to facilitate retaining thereof within said tertiary target zone.

2. An aerial projectile and target apparatus for use in playing a lawn target game as defined in claim 1 wherein first flexible member and said second flexible member are both square.

3. An aerial projectile and target apparatus for use in playing a lawn target game as defined in claim 1 wherein said throwing hook and loop interlocking material section includes at least two individual strip sections of hook and loop interlocking material on said first outer surface of said first flexible member to facilitate selective engagement of said bag-like throwing member with said target member.

4. An aerial projectile and target apparatus for use in playing a lawn target game as defined in claim 3 wherein said individual strip sections of hook and loop interlocking material are approximately ¾ inch in width.

5. An aerial projectile and target apparatus for use in playing a lawn target game as defined in claim 1 wherein said pelletized filler material comprises rubber pellets.

6. An aerial projectile and target apparatus for use in playing a lawn target game as defined in claim 1 wherein said pelletized filler material comprises sand.

7. An aerial projectile and target apparatus for use in playing a lawn target game as defined in claim 1 wherein said first flexible member and said second flexible member are made of flexible plastic.

8. An aerial projectile and target apparatus for use in playing a lawn target game as defined in claim 1 wherein said first flexible member and said second flexible member are made of leather.

9. An aerial projectile and target apparatus for use in playing a lawn target game as defined in claim 1 wherein said pelletized filler material and said bag-like throwing member weigh from five to eight ounces.

10. An aerial projectile and target apparatus for use in playing a lawn target game as defined in claim 1 further including a quaternary target zone for providing a detrimental target during game play.

11. An aerial projectile and target apparatus for use in playing a lawn target game as defined in claim 10 wherein said primary target zone, said secondary target zone, said tertiary target zone and said quaternary target zone each are rectangular.

12. An aerial projectile and target apparatus for use in playing a lawn target game as defined in claim 10 wherein said secondary target zone is positioned adjacent said primary target zone and said tertiary zone is positioned adjacent said secondary zone and said quaternary zone is positioned adjacent said primary target zone opposite from the location of said secondary target zone.

13. An aerial projectile and target apparatus for use in playing a lawn target game as defined in claim 12 wherein said primary target zone and said primary target zone are equal in size.

14. An aerial projectile and target apparatus for use in playing a lawn target game as defined in claim 13 wherein said secondary target zone is larger than said primary target zone and where said tertiary target zone is larger than said secondary target zone.

15. An aerial projectile and target apparatus for use in playing a lawn target game as defined in claim 1 wherein said tertiary target zone is rectangular.

16. An aerial projectile and target apparatus for use in playing a lawn target game as defined in claim 15 wherein said secondary target zone is annular and is positioned within said rectangular tertiary target zone.

17. An aerial projectile and target apparatus for use in playing a lawn target game as defined in claim 15 wherein said primary target zone is circular and is positioned within said secondary target zone.

18. An aerial projectile and target apparatus for use in playing a lawn target game as defined in claim 15 further comprising a quaternary target zone, positioned adjacent said tertiary target zone, which includes a quaternary hook and loop interlocking material section affixed therein to facilitate engagement with said bag-like throwing member.

19. An aerial projectile and target apparatus for use in playing a lawn target game as defined in claim 15 further comprising a corner securement means peripherally located on the target member to facilitate maintenance thereof in a flat horizontal orientation.

20. An aerial projectile and target apparatus for use in playing a lawn target game comprising:

A. a bag-like throwing member including:

(1) a first flexible member being square and of plastic material and defining a first outer surface and a first inner surface, said first outer surface of said first flexible member including a throwing hook and loop interlocking material section comprising at least one first hook strip member of approximately ¾ inch in width thereon to facilitate game play;

(2) a second flexible member being square and of plastic material and defining a second outer surface and a second inner surface, said first flexible member and said second flexible member being peripherally attached with respect to one another with said first inner surface and said second inner surface being adjacently positioned facing one another and with said first outer surface and said second outer surface outwardly facing opposite from one another, said first inner surface and said second inner surface defining an internal chamber means therebetween;

B. a pelletized filler material positioned within said internal chamber means of said bag-like throwing member for weighting thereof to facilitate tossing and targeting thereof, said pelletized filler material weighing approximately five to eight ounces;

C. a target member defining a plurality of target zones to facilitate target game play by tossing of said bag-like throwing member therewithin, said target member including:

(1) a primary target zone which is rectangular for providing a primary target during game play, said primary target zone including a primary hook and loop interlocking material section affixed therein and adapted to be selectively engageable with respect to said throwing hook and loop interlocking material section on said bag-like throwing member to facilitate retaining thereof within said primary target zone;

(2) a secondary target zone which is rectangular and is positioned adjacent said primary target zone for providing a secondary target during game play, said secondary target zone being larger than said primary target zone, said secondary target zone including a secondary hook and loop interlocking material section affixed therein and adapted to be selectively engageable with respect to said throwing hook and loop interlocking material section on said bag-like throwing member to facilitate retaining thereof within said secondary target zone;

(3) a tertiary target zone which is rectangular and is positioned adjacent said secondary target zone for providing a tertiary target during game play, said tertiary target zone being larger than said secondary target zone, said tertiary target zone including a tertiary hook and loop interlocking material section affixed therein and adapted to be selectively engageable with respect to said throwing hook and loop interlocking material section on said bag-like throwing member to facilitate retaining thereof within said tertiary target zone; and (4) a quaternary target zone which is rectangular and is positioned adjacent said primary target zone opposite from the position of said secondary target zone for providing a quaternary target during game play which is detrimental, said quaternary target zone being equal in size to said primary target zone, said quaternary target zone including a quaternary hook and loop interlocking material affixed therein and adapted to be selectively engageable with respect to said throwing hook and loop interlocking material section on said bag-like throwing member to facilitate retaining thereof within said quaternary target zone.

21. An aerial projectile and target apparatus for use in playing a lawn target game comprising:

A. a bag-like throwing member including:

(1) a first flexible member being square and of plastic material and defining a first outer surface and a first inner surface, said first outer surface of said first flexible member including a throwing hook and loop interlocking material section comprising at least one first hook and loop strip member of approximately ¾ inch in width thereon to facilitate game play;

(2) a second flexible member being square and of plastic material and defining a second outer surface and a second inner surface, said first flexible member and said second flexible member being peripherally attached with respect to one another with said first inner surface and said second inner surface being adjacently positioned facing one another and with said first outer surface and said second outer surface outwardly facing opposite from one another, said first inner surface and said second inner surface defining an internal chamber means therebetween;

B. a pelletized filler material positioned within said internal chamber means of said bag-like throwing member for weighting thereof to facilitate tossing and targeting thereof, said pelletized filler material weighing approximately five to eight ounces;

C. a target member defining a plurality of target zones to facilitate target game play by tossing of said bag-like throwing member therewithin, said target member including:

(1) a primary target zone for providing a primary target during game play, said primary target zone being circular, said primary target zone including a primary hook and loop interlocking material section affixed therein comprising at least one strip of hook and loop interlocking material which is adapted to be selectively engageable with respect to said throwing hook and loop interlocking material section on said bag-like throwing member to facilitate retaining thereof within said primary target zone;

(2) a secondary target zone for providing a secondary target during game play, said secondary target zone being annular surrounding said primary target zone, said secondary target zone including a secondary hook and loop interlocking material section affixed therein comprising at least one strip of hook and loop interlocking material which is adapted to be selectively engageable with respect to said throwing hook and loop interlocking material section on said bag-like throwing member to facilitate retaining thereof within said secondary target zone;

(3) a tertiary target zone for providing a tertiary target during game play, said tertiary target zone being rectangular and surrounding said secondary target zone, said tertiary target zone including a tertiary hook and loop interlocking material section affixed therein comprising at least one strip of hook and loop interlocking material which is adapted to be selectively engageable with respect to said throwing hook and loop interlocking material section on said bag-like throwing member to facilitate retaining thereof within said tertiary target zone; and (4) a quaternary target zone for providing a quaternary target during game play, said quaternary target zone being rectangular and adjacent said tertiary target zone, said quaternary target zone including a quaternary hook and loop interlocking material section affixed therein comprising at least one strip of hook and loop interlocking material which is adapted to be selectively engageable with respect to said throwing hook and loop interlocking material section on said bag-like throwing member to facilitate retaining thereof within said quaternary target zone.

* * * * *